US007134374B1

(12) United States Patent
Williamson et al.

(10) Patent No.: US 7,134,374 B1
(45) Date of Patent: Nov. 14, 2006

(54) SAFETY CABLE CUTTER FOR CUTTING A CABLE USED IN SERVICING AN OIL AND GAS WELL

(76) Inventors: Alan M. Williamson, P.O. Box 7253, Gillette, WY (US) 82717; Cody Williamson, P.O. Box 7253, Gillette, WY (US) 82717

( * ) Notice: Subject to any disclaimer, the term of this patent is extended or adjusted under 35 U.S.C. 154(b) by 0 days.

(21) Appl. No.: 10/969,608

(22) Filed: Oct. 21, 2004

(51) Int. Cl.
*B26D 1/01* (2006.01)

(52) U.S. Cl. ..... 83/597; 83/370; 83/586; 83/950; 166/54.5; 166/55.2; 187/349

(58) Field of Classification Search ..... 83/597, 83/221, 223, 224, 230, 373, 396, 582, 586, 83/587, 628, 734, 856, 950, 360, 370, 949; 166/55.2, 55.3, 54.5, 54.6
See application file for complete search history.

(56) References Cited

U.S. PATENT DOCUMENTS 2,495,732 A * 1/1950 Jessen ..... 244/3
3,962,943 A * 6/1976 Allen ..... 83/370
4,826,103 A * 5/1989 McKown ..... 244/1 R
5,511,311 A * 4/1996 Collins ..... 30/162
6,427,334 B1 * 8/2002 Onion ..... 30/161
6,526,858 B1 * 3/2003 Smith et al. ..... 83/856
6,684,510 B1 * 2/2004 Collins ..... 30/161
2003/0074739 A1 * 4/2003 Seber et al. ..... 7/128

* cited by examiner

*Primary Examiner*—Boyer D. Ashley
*Assistant Examiner*—Edward Landrum
(74) *Attorney, Agent, or Firm*—Edwin H. Crabtree; Ramon L. Pizarro

(57) ABSTRACT

A safety cable cutter used for cutting a cable used in servicing an oil and gas well. A centrifugal arm roller and a guide roller are mounted on top of a frame. The cable is received on the rollers as the cable is lowered down a well bore. Mounted on ends of the centrifugal arm roller is a centrifugal arm attached to an arm coil spring. The coil spring holds the centrifugal arm next to the end of the roller. Opposite ends of a clamp attached to a cutter bar are slidably received in a pair of cutter bar guides. When the centrifugal arm roller exceeds a certain speed indicating a free fall of the cable, the bias force of the arm coil springs is overcome and the arms move outwardly. Contact ends of the arms engage the opposite ends of the clamp. The clamp and cutter bar are then moved outwardly and the cutter bar cuts the cable.

13 Claims, 2 Drawing Sheets

SAFETY CABLE CUTTER FOR CUTTING A CABLE USED IN SERVICING AN OIL AND GAS WELL

BACKGROUND OF THE INVENTION (a) Field of the Invention

This invention relates to a cable cutter for cutting heavy duty cable and more particularly, but not by way of limitation, to a safety cable cutter using centrifugal force for cutting the cable. The cable used for lowering various types of service equipment down an existing oil and gas well.

(b) Discussion of Prior Art

In servicing an oil and gas well having various depths of 500 to 1000 feet and greater, heavy wire cable is coiled typically in twenty foot coils next to a well head. An end of the cable is attached to different types of service equipment, such as an electric motor with pump, and then lowered downwardly into the well bore. Should the equipment with cable attached thereto begin to free fall down the well bore, the coils of cable will begin to fly randomly and dangerously next to the well head presenting a great safety risk to a well service company employee working in the well head area. The subject safety cable cutter is designed to eliminate this potential safety risk.

Heretofore, there have been a variety of different types well service equipment used for serving an oil and gas well down hole. For example, in U.S. Pat. No. 4,512,411 to Pringle, a well service line cutter is disclosed having a down hole energy chamber holding a pressurized gas. When a hydraulic controlled valve is opened in the energy chamber, a piston with cutters move into the well bore for cutting any line in the well. In U.S. Pat. No. 4,738,312 to Wittrisch, a cable cutting coupling inside the well is described. The coupling includes a tubular body with a slide. The slide includes a severing member for cutting the cable when it is moved from a first position to a second position inside the tubular body. In U.S. Pat. No. 4,886,115 to Leggett et al., a wireline safety mechanism with a tubular body is disclosed mounted between a lubricator and a stuffing box of a wireline assembly. A wireline cutter is mounted inside the tubular body to cut the wireline and release a wireline blowout tool string that is stuck and blocking a wellhead safety valve and blowout preventor.

None of the above mentioned prior art patents specifically disclose the unique features, structure and function of the subject safety cable cutter placed next to a well head and used to cut a service cable when it begins to free fall down a well bore.

SUMMARY OF THE INVENTION

In view of the foregoing, it is a primary objective of the subject invention to prevent a serious injury to a well service company employee working next to a well head should for some reason a cable with well service equipment attached thereto begin to free fall down the well bore. Centrifugal force is used for automatically activating the cable cutter during it's operation.

Another object of the invention is cable cutter is designed to engage, cut or stop the cable as it is lowered into the well bore and prevent cable coils laying on the ground from whipping back and forth and flying through the air should a free fall occur.

Still another object of the cable cutter is designed for attachment to the side of a set of bowl slips which are attached to a well head and adapted for engagement of different sizes and types of well service cable used in lowering well casing, well tubing, pump and motor, nitro and sensor, camera and other like service equipment.

The safety cable cutter includes a cable cutter frame adapted for attachment to a pair of bowl slips attached to a side of the well head and next to a ground surface. A centrifugal arm roller and a guide roller are mounted on top of the frame. A portion of a well service cable is received on the two rollers as the cable is lowered down a well bore. Mounted on opposite ends of the centrifugal arm roller is a pivotally mounted centrifugal arm attached to an arm coil spring. The coil spring holds the centrifugal arm next to the end of the roller and inside a circumference of the arm roller. Opposite ends of a clamp attached to a cutter bar are slidably received in a pair of cutter bar guides. The two cutter bar guides are mounted on the frame. When the centrifugal arm roller exceeds a certain speed indicating a free fall of the cable, the bias force of the arm coil springs is overcome and the two centrifugal arms move outwardly. At this time, contact ends of the arms engage a portion of the opposite ends of the clamp. The clamp and cutter bar are moved from a disengaged position outwardly on the cutter bar guides and toward the guide roller into an engaged position. The cutter bar, in the engaged position, now engages and cuts the cable. At the same time, a pair of spring biased stop, mounted on opposite sides of the frame, move upwardly and engage the ends of the clamp thus preventing the cutter bar from sliding backward on the cutter bar guides and into the disengaged position.

These and other objects of the present invention will become apparent to those familiar with various types oil and gas well service equipment when reviewing the following detailed description, showing novel construction, combination, and elements as herein described, and more particularly defined by the claims. It should be understood that changes in the various embodiments of invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of thereof, and in which.

DETAILED DESCRIPTION OF THE PREFERRED EMBODIMENTS

Figure 1:
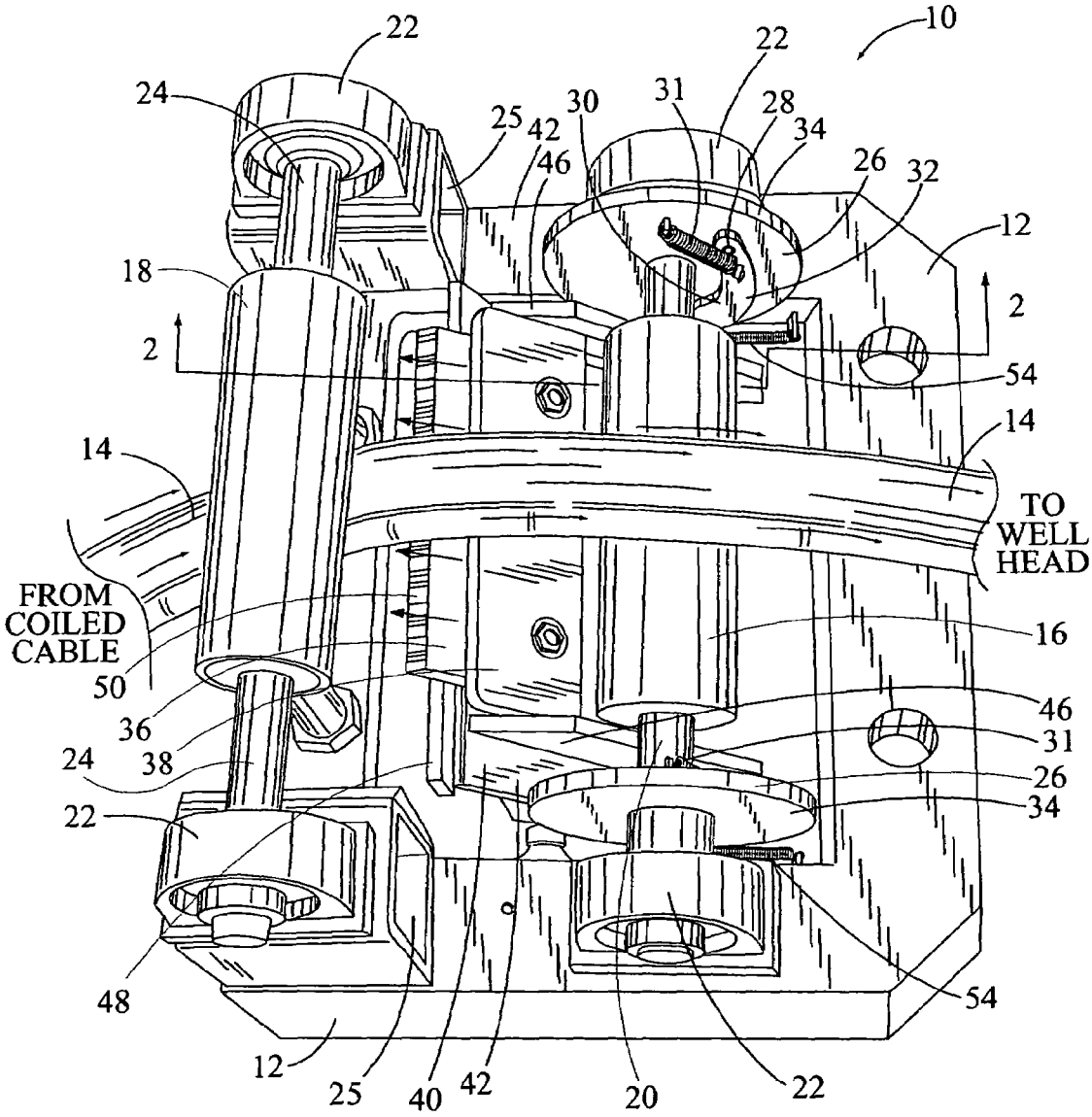
FIG. 1 is a perspective view of the subject safety cable cutter is shown mounted on a cable cutter frame. The frame is adapted for attachment to a side of a set of bowl slips attached to a well head. In this view, a portion of a heavy well service cable is shown received over a top of a centrifugal arm roller and under a bottom of a guide roller. A cutter bar, mounted on an upper and lower clamp, is shown with a cutting edge disposed below the cable and pointed toward the guide roller.

In FIG. 1, a perspective view of the subject safety cable cutter is shown having a general reference numeral 10. The cable cutter 10 is mounted on a cable cutter frame 12. The frame 12 is adapted for attachment to a side of a set of bowl slips attached to an oil and gas well head. The bowl slips and the well head are not shown in the drawings. In this view, a portion of a heavy well service cable 14 is shown received over a top of a centrifugal arm roller 16 and under a bottom of a guide roller 18. The arm roller 16 includes a shaft 20 with opposite ends mounted on pillow block bearings 22 mounted on the frame 12. Also, the guide roller 18 includes a shaft 24 with opposite ends mounted on pillow block bearings 22 attached to tubular bases 25 mounted on the frame 12. The centrifugal arm roller 16 also includes a pair of annular flange plates 26 mounted on the opposite ends of the shaft 20. The cable 14, as mentioned above, is used for lowering various types of well service equipment down the well bore.

Figure 3:
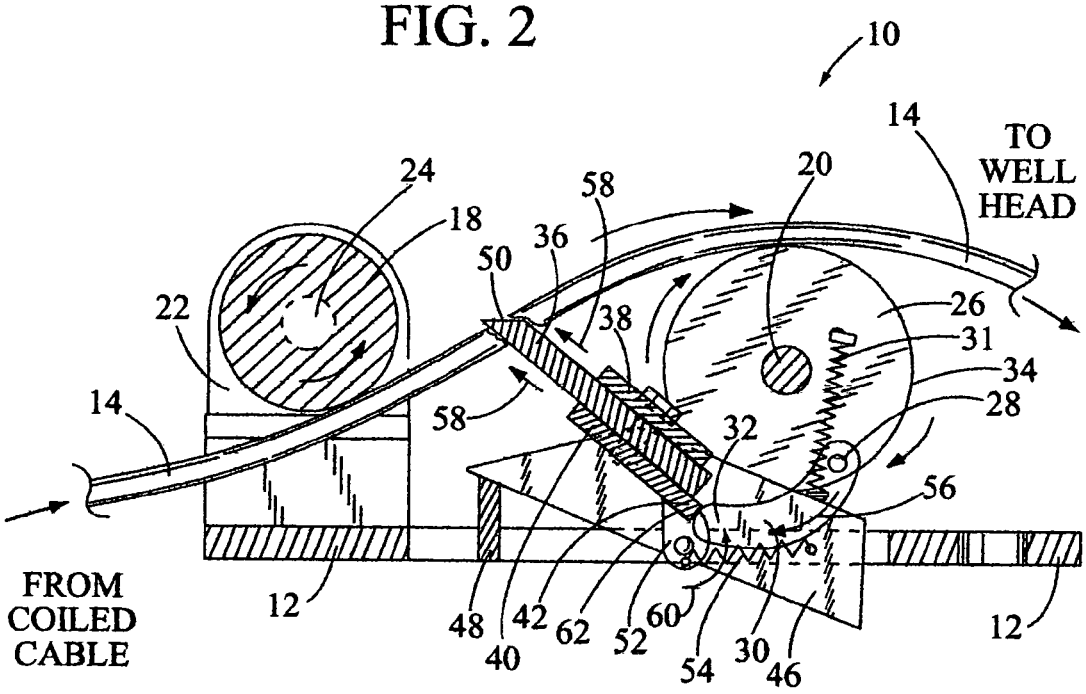
FIG. 3 is a side sectional view of the cable cutter and similar to FIG. 2. In this view, the cable has begun to free fall down a well bore. The speed of the centrifugal arm roller has increased and the centrifugal arm has moved outwardly due to centrifugal force. An end of the arm has engaged a portion of the clamp moving the clamp and the cutter bar outwardly on a cutter bar guide. The cutter bar is shown cutting the cable.

A pivot end 28 of a pair of centrifugal arms 30 is pivotally mounted on each of the flange plates 26. Only one of the arms 28 can be seen in the upper right of this drawing. The centrifugal arm 30 is disposed next to the side of the flange plate 26 and held in place using an arm coil spring 31. In a retracted position of the centrifugal arm 30, a contact end 32 of the arm 28 is held inside a circumference 34 around the two flange plates 26. When the arm roller 16 exceeds a certain speed, with the cable 14 riding thereon, the bias force of the arm coil spring 31 is overcome and by centrifugal force the centrifugal arm 30 moves outwardly in a counterclockwise direction, as shown in FIG. 3.

The safety cable cutter 10 also includes a cutter bar 36 held between an upper clamp 38 and a lower clamp 40. Opposite ends 42 of the lower clamp 40 are slidably received inside a slide opening 44 in a pair of cutter bar guides 46. The cutter bar guides 46 are attached to the sides of the frame 12 and a crossbar 48. A cutting edge 50 of the cutter bar 46 is pointed outwardly toward the guide roller 18 and positioned under a portion of the cable 14. The opposite ends 42 of the lower clamp 40 are adapted for sliding outwardly when contacted by the contact ends 32 of the two centrifugal arms 30 for moving the cutting edge 50 of the cutter bar 46 into engagement of the cable 14 as shown in FIG. 3.

Figure 2:
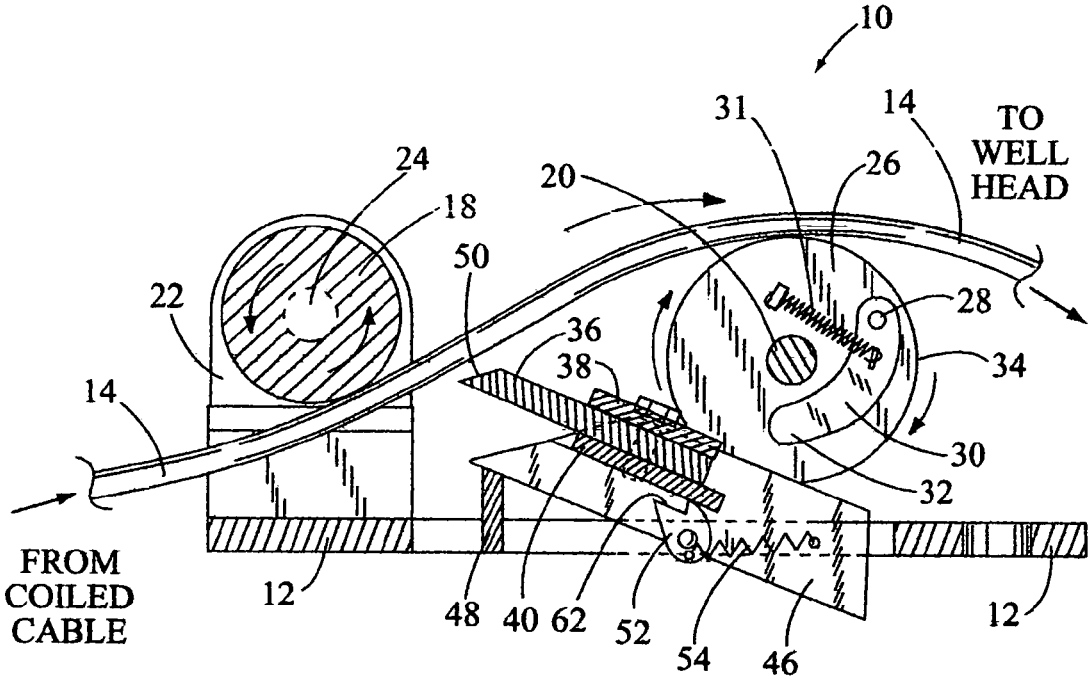
FIG. 2 is a side sectional view of the cable cutter taken along lines 2—2 shown in FIG. 1. In this view, a spring biased centrifugal arm is shown pivotally mounted on an annular flange plate attached to a shaft of the centrifugal arm roller. An arm coil spring holds the centrifugal arm in a retracted position and within a circumference of the flange plate.

In FIG. 2, a side sectional view of the cable cutter 10 is shown and taken along lines 2—2 shown in FIG. 1. In this view, the spring biased centrifugal arm 30 is shown pivotally mounted on an annular flange plate 26. The arm coil spring 31 is shown holding the centrifugal arm 30 within the circumference 34 of the flange plate 26.

Also shown in this drawing is one of a pair of clamp stops 52. The stops 52 are pivotally attached to opposite sides of the frame 12. Each of the stops 52 is connected to a stop spring 54. The stop springs 54 are used to bias the stops against a portion of the opposite ends 42 of the lower clamp 40. The stops 52 are used to hold the cutter bar 36 in an extended position when cutting the cable 14.

In FIG. 3, another side sectional view of the cable cutter 10 is shown and similar to FIG. 2. In this view, the cable 14 has begun to free fall down a well bore. The speed of the centrifugal arm roller 16 has increased in a range of 12 to 15 feet per second and greater. At this time, the two centrifugal arms 30 have moved outwardly, as indicated by arrow 56, due to centrifugal force. The contact end 32 of the two arms 30 has engaged a portion of the opposite ends 42 of the lower clamp 40 moving the two clamps 38 and 42 and the cutter bar 40 outwardly, as indicated by arrows 58, on the cutter bar guides 46. The cutting edge 50 of cutter bar 36 is shown cutting the cable 14 and preventing the coils of the cable from whipping back and forth and possibly injuring someone working in the area around the well head.

In this drawing, one of the pair of clamp stops 52 is shown having moved upwardly in a counterclockwise direction, as indicated by arrow 60, by the stop spring 54. A notch 62 in one end of the clamp stop 52 is shown received around a portion of the end 42 of the lower clamp 40. The two stops 52, in this position, are used to hold the clamps 38 and 40 and the cutter bar 36 in an extended position when cutting the cable 14 and preventing the cutter bar 36 moving backward into a retracted position on the cutter bar guides 46.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. A safety cable cutter used for cutting a cable, the cable used in servicing an oil and gas well and lowered down a well bore, the cable adapted for attachment to a well head next to a ground surface, the cable cutter comprising:

a cable cutter frame;

a centrifugal arm roller mounted on said frame, said arm roller adapted for receiving a portion of the cable thereon;

a first centrifugal arm pivotally mounted on said arm roller;

a first cutter bar guide mounted on said frame; and a cutter bar slidably mounted on said guide;

whereby when the speed of said arm roller indicates a free fall of the cable in the well bore, said first centrifugal arm moves outwardly from said arm roller and engages said cutter bar and slides said cutter bar outwardly on said first guide, said cutter bar engaging and cutting the cable.

2. The cable cutter as described in claim 1 further including a guide roller mounted on said frame, said guide roller adapted for receiving a portion of the cable thereon.

3. The cable cutter as described in claim 1 further including a stop, said stop pivotally mounted on said frame, said stop engaging said cutter bar and holding it in place when said cutter bar engages and cuts the cable.

4. The cable cutter as described in claim 1 further including a clamp for holding said cutter bar on said guide.

5. The cable cutter as described in claim 1 further including a second centrifugal arm mounted on one end of said arm roller for engaging said cutter bar, said first centrifugal arm mounted on an opposite end of said arm roller.

6. The cable cutter as described in claim 1 further including a second cutter bar guide mounted on one side of said frame, said second cutter bar guide mounted on an opposite side of said frame.

7. A safety cable cutter used for cutting a cable, the cable used in servicing an oil and gas well and lowered down a well bore, the cable cutter adapted for attachment to a well head next to a ground surface, the cable cutter comprising:

a cable cutter frame;

a centrifugal arm roller mounted on said frame, said arm roller adapted for receiving a portion of the cable thereon;

a first centrifugal arm pivotally mounted on one end of said arm roller and a second centrifugal arm pivotally mounted on an opposite end of said arm roller;

a first cutter bar guide mounted on one side of said frame and a second cutter bar guide mounted on an opposite side of said frame; and a cutter bar slidably mounted on said first and second guides;

whereby when the speed of said arm roller indicates a free fall of the cable in the well bore, said first and second centrifugal arm move outwardly from said arm roller and engages said cutter bar and slides said cutter bar outwardly on said first and second guides, said cutter bar engaging and cutting the cable.

8. The cable cutter as described in claim 7 further including a guide roller mounted on said frame, said guide roller adapted for receiving a portion of the cable thereon.

9. The cable cutter as described in claim 7 further including a first stop pivotally mounted on one side of said frame and a second stop pivotally mounted on an opposite side of the said frame, said stops engaging opposite sides of said cutter bar and holding it in place when said cutter bar engages and cuts the cable.

10. The cable cutter as described in claim 7 further including an upper clamp and a lower clamp for holding said cutter bar on said first and second guides.

11. A safety cable cutter used for cutting a cable, the cable used in servicing an oil and gas well and lowered down a well bore, the cable cutter adapted for attachment to a well head next to a ground surface, the cable cutter comprising:

a cable cutter frame;

a centrifugal arm roller mounted on said frame, said arm roller adapted for receiving a portion of the cable thereon;

a spring biased first centrifugal arm pivotally mounted on one end of said arm roller and a spring biased second centrifugal arm pivotally mounted on an opposite end of said arm roller;

a first cutter bar guide mounted on one side of said frame and a second cutter bar guide mounted on an opposite side of said frame; and a cutter bar disposed between an upper clamp and a lower clamp, said cutter bar and said upper and lower clamps slidably mounted on said first and second guides;

whereby when the speed of said arm roller indicates a free fall of the cable in the well bore, said first and second centrical arm move outwardly from said arm roller and engages said cutter bar and slides said cutter bar outwardly on said first and second guides, said cutter bar engaging and cutting the cable.

12. The cable cutter as described in claim 11 further including a guide roller mounted on said frame, said guide roller adapted for receiving a portion of the cable thereon.

13. The cable cutter as described in claim 11 further including a spring biased first top pivotally mounted on one side of said frame and a spring biased second stop pivotally mounted on an opposite side of the said frame, said stops engaging opposite sides of said cutter bar and holding it in place when said cutter bar engages and cuts the cable.

* * * * *